US005358440A

United States Patent [19]

Zheng

[11] Patent Number: 5,358,440

[45] Date of Patent: Oct. 25, 1994

[54] COLLAPSIBLE FLYING DISC

[76] Inventor: Yu Zheng, 1065 Howard Ave., Covina, Calif. 91722

[21] Appl. No.: 178,050

[22] Filed: Jan. 6, 1994

[51] Int. Cl.[5] ..... A63H 27/00; A63H 33/00

[52] U.S. Cl. ..... 446/48; 446/46; 446/487

[58] Field of Search ..... 446/34, 46, 47, 48, 446/80, 486, 487; 273/424, 425, 126 R

[56] References Cited

U.S. PATENT DOCUMENTS

| | | | |
|---|---|---|---|
| 3,939,602 | 2/1976 | Burk et al. | 446/48 |
| 4,115,946 | 9/1978 | Vukmirovich | 446/46 X |
| 4,201,009 | 5/1980 | Burridge, Jr. | 446/48 X |
| 4,204,357 | 5/1980 | Harrington | 273/424 X |
| 4,223,473 | 9/1980 | Brown . | |
| 4,241,533 | 12/1980 | Newsome . | |
| 4,290,226 | 9/1981 | Stauffer | 446/46 |
| 4,456,265 | 6/1984 | Adler . | |
| 4,503,635 | 3/1985 | Harrington | 446/46 |
| 4,560,358 | 12/1985 | Adler . | |
| 4,709,928 | 12/1987 | Willingham . | |
| 4,832,652 | 5/1989 | Matsuyama | 446/46 X |
| 4,994,707 | 7/1990 | Silverglate . | |
| 5,078,637 | 1/1992 | McFarland | 446/48 X |
| 5,261,846 | 11/1993 | Hanna | 446/46 |

*Primary Examiner*—Robert A. Hafer
*Assistant Examiner*—D. Neal Muir
*Attorney, Agent, or Firm*—Raymond Sun

[57] ABSTRACT

A flexible flying disc having a first rim member and a panel substantially covering the rim member. The first rim member and the panel may be twisted and folded to substantially reduce the size of the flying disc. In a separate embodiment, the flying disc may further include a second rim member and a collar encompassing the first rim member and the panel, with the collar attached between the first and second rim members. The first and second rim members are disposed in different elevational planes but parallel to each other so that the collar is disposed at an angle, thereby creating a domed structure. Mesh portions and openings may be provided in the panel to allow air to pass therethrough during flight. The first and second rim members, the panel and the collar may also be twisted and folded to substantially reduce the size of the flying disc.

15 Claims, 8 Drawing Sheets

COLLAPSIBLE FLYING DISC

BACKGROUND OF THE INVENTION

1. Field of the Invention

The present invention relates to flying discs, and specifically a collapsible flying disc and embodiments thereof which exhibit aerodynamically stable flight and which may be folded and collapsed for conveniently storing them in a pocket. The present invention also relates to methods for folding and collapsing the collapsible flying disc.

2. Description of the Prior Art

Prior art flying discs have come in several forms. One type of these flying discs is generally rigid in construction. However, such rigid flying discs suffer from a number of drawbacks, most notably that their rigidity causes damage to items or potential injury to individuals upon impact. This has restricted the use or play of such rigid flying discs to open areas where there are not many people or damageable items. Another drawback of such rigid flying discs is that they cannot be folded and placed in a pocket, thereby making them very inconvenient in that the user must carry them or otherwise find a bag or container large enough to hold them.

A second form of flying discs are generally flexible so that they do not cause damage or injury upon impact. Therefore, they can be used or tossed in more places, such as indoors and at crowded places. Some of these flexible flying discs can be folded and collapsed into a smaller size to fit in a pocket, but many of them cannot be folded and collapsed easily. Other flexible flying discs have very complex structures and configurations which render them expensive to manufacture, and sometimes, difficult to use and collapse.

Thus, there remains a need for a flexible flying disc that is lightweight, is easy to use, is inexpensive to manufacture, can be easily folded and collapsed to fit conveniently in a pocket, is aerodynamically sound, and is stable in flight.

SUMMARY OF THE DISCLOSURE

The objects of the present invention may be achieved by providing, in a first preferred embodiment, a flexible flying disc comprising an enclosed resilient loop having a folded and an unfolded orientation. The flying disc further comprises a binding for retaining the resilient loop, and a panel substantially covering the resilient loop in its unfolded orientation and attached to an internal edge of the binding. The panel has means for allowing air to pass therethrough, such means comprising one or more mesh portions and/or a plurality of openings provided in the panel. The resilient loop and the panel of the flying disc may be twisted and folded to form a plurality of concentric loops and panels to substantially reduce the size of the flying disc. Weights may be provided in spaced-apart manner along the internal edge of the binding.

In another preferred embodiment, the flying disc according to the present invention comprises a first enclosed rim member having a folded and an unfolded orientation, and a panel substantially covering the first enclosed rim member in its unfolded orientation and attached to an inner edge of the first enclosed rim member. The flying disc further comprises a second enclosed rim member having a folded and an unfolded orientation. The flying disc also includes a collar surrounding the first enclosed rim member and having a first edge attached to an outer edge of the first enclosed rim member, and a second edge connected to an inner edge of the second enclosed rim member. The second enclosed rim member is wider than the first enclosed rim member, and both the first and second enclosed rim members are disposed at different elevational planes such that the collar is disposed at an angle to form a domed structure. The first and second enclosed rim members, the panel and the collar may be twisted and folded to form a plurality of concentric rim members and panels to substantially reduce the size of the flying disc. Mesh portions and openings may also be provided on the panel to allow air to pass therethrough. Optional weights may be provided in spaced-apart manner along the collar.

The present invention further includes a method for folding and collapsing a flying disc. This method provides for a flying disc comprising a first enclosed rim member, a panel substantially covering the first enclosed rim member in its unfolded orientation and attached to an inner edge of the first enclosed rim member, a second enclosed rim member having an inner edge along its periphery, with a collar surrounding the first enclosed rim member and having a first edge attached to the outer edge of the first enclosed rim member and a second edge connected to the inner edge of the second enclosed rim member, wherein the second enclosed rim member is wider than the first enclosed rim member, and wherein both the first and second enclosed rim members are disposed at different elevational planes such that the collar is disposed at an angle. The method further comprises the steps of compressing the collar such that the first and second enclosed rim members are disposed along substantially the same plane, and then twisting and folding the first and second enclosed rim members, the panel and the collar to form a plurality of concentric rim members and panels to substantially reduce the size of the flying disc.

Thus, the flexible flying disc according to the present invention is lightweight, easy to use, inexpensive to manufacture, is aerodynamically sound and is stable in flight. The present invention also provides methods for folding and collapsing the flying disc such that the flying disc can be easily folded and collapsed to fit conveniently in a pocket.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
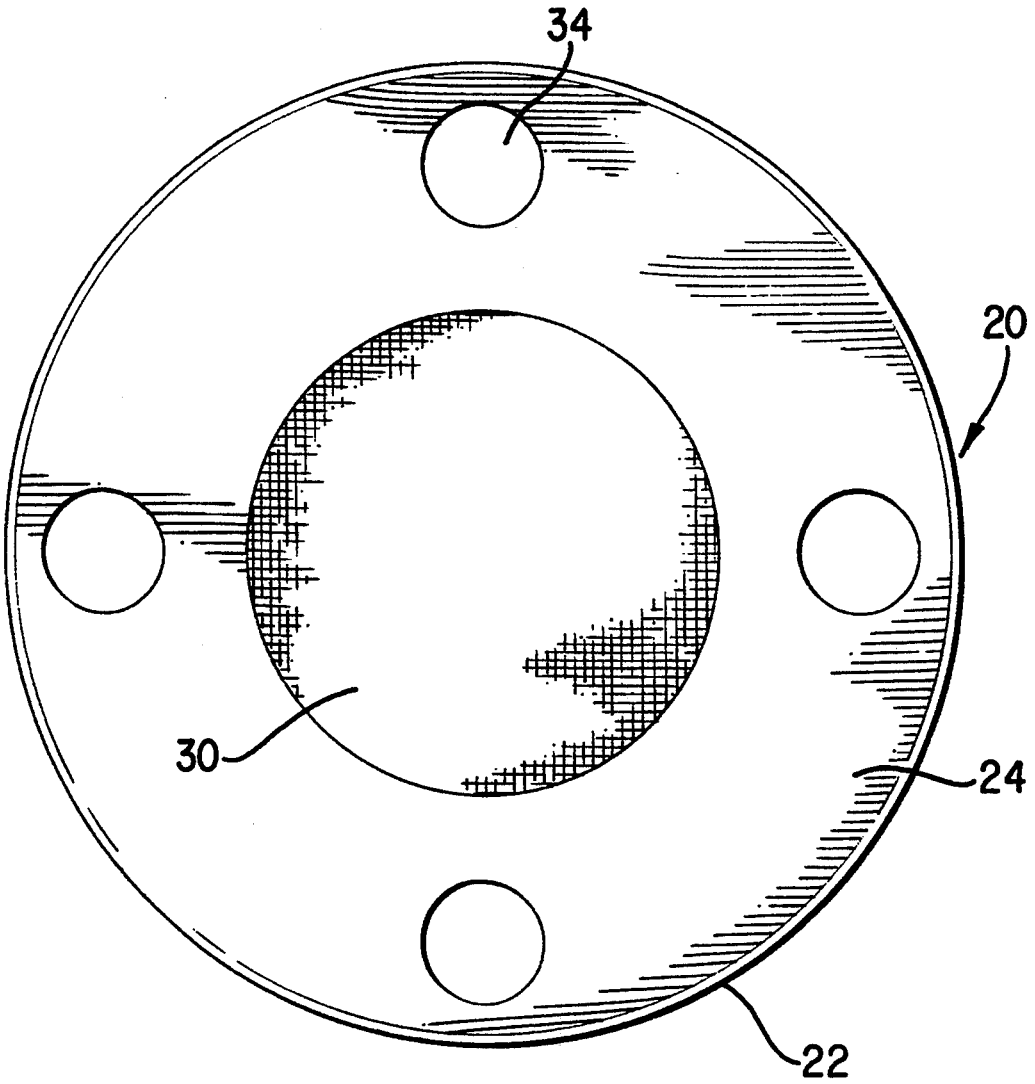
FIG. 1 is a top plan view of a flying disc according to a first embodiment of the present invention.
Figure 5:
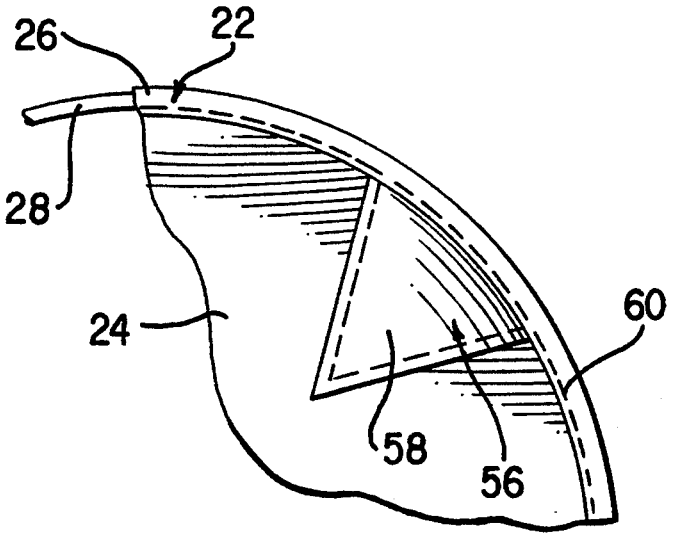
FIG. 5 is a cut-away perspective view of section 5—5 of FIG. 3 showing the curved resilient loop housed in the curved binding of the flying disc of FIG. 3 and a weight provided along the periphery thereof.

As shown in FIGS. 1 and 5, the basic structure for a flying disc 20 in accordance with a first embodiment of the present invention comprises a circular rim member 22 which encloses a panel 24. Although FIG. 5 more accurately illustrates the embodiment of FIG. 3, it also exhibits certain features of FIG. 1 that are found in the embodiments of FIGS. 1 and 3, and is referred to here for illustrative purposes. Referring to FIG. 5, the circular rim member 22 comprises a circular binding 26 which houses a resilient loop 28. The loop 28 also has a circular configuration. The loop 28 may be held within the binding 26 without any attachment, or the binding 26 may be mechanically fastened, stitched, fused, or glued to the loop 28 to retain it in position. The loop 28 should be made of a lightweight material which is relatively strong and yet is flexible to a sufficient degree to allow it to be coiled. The loop 28 is preferably formed of flexible coilable steel, although other materials such as plastics may also be used. The loop 28 may be made as one continuous loop, or may be formed by taking one strip of flexible coilable material, bending it, and connecting both ends of the strip of material by means of a connector or other conventional means.

The panel 24 is preferably made from a fabric material. The term "fabric" preferably includes strong, lightweight materials and may include woven fabrics, sheet fabrics, nylons, spunbond, knits, or even films. The panel 24 and the binding 26 may be provided separately and then stitched or attached together. Alternatively, the binding 26 may be made from an extension of the panel 24 fabric by folding the peripheral edge of the panel 24 over the loop 28 and stitching to form the binding 26.

The panel 24 further comprises a central mesh portion 30 which, in one embodiment, is made by cutting out a central opening from the panel 24 and attaching the mesh material to the opening. The mesh portion 30 is preferably made from a perforated or net material, such as nylon, perforated spunbond or knit. Alternatively, the mesh portion 30 may be formed by taking the panel 24 and providing small perforations or holes in the region of the mesh portion 30. The mesh portion 30 may be made of any shape, and is shown, for example, in FIG. 1 as being circular. Further, the mesh portion 30 preferably covers approximately twenty-five percent of the total surface area of the panel 24, and preferably no more than fifty percent of the total surface area of the panel 24.

The panel 24 may additionally be provided with a plurality of openings 34 cut from the panel 24. Preferably, at least four but not more than twelve openings 34 should be spaced apart along the panel 24. The openings 34 can be made of any shape, and are shown in FIG. 1 as being circular with a diameter preferably between 0.5 inches and 1.5 inches.

The mesh portion 30, which itself has a number of small perforations or holes, and the actual openings 34 allow air to pass therethrough. The present inventor has found that the provision of the mesh portion 30, with its small perforations or holes, and the actual openings 34, provide the flying disc 20 with a more stable and predictable flight path when air is allowed to pass through the panel of the flying disc.

It will be appreciated by those skilled in the art that the resilient loop 28 also acts as a weight. The weight provided by the loop 28 provides the flying disc 20 with a balance which meets the required aerodynamics. Furthermore, the diameter of the rim member 22 has a bulbous shape and is larger than the thickness of the panel 24. Hence, the rim member 22 presents a toroidal leading edge which provides a gyroscopic effect that lends further stability to the flight of the flying disc 20.

Figure 2:
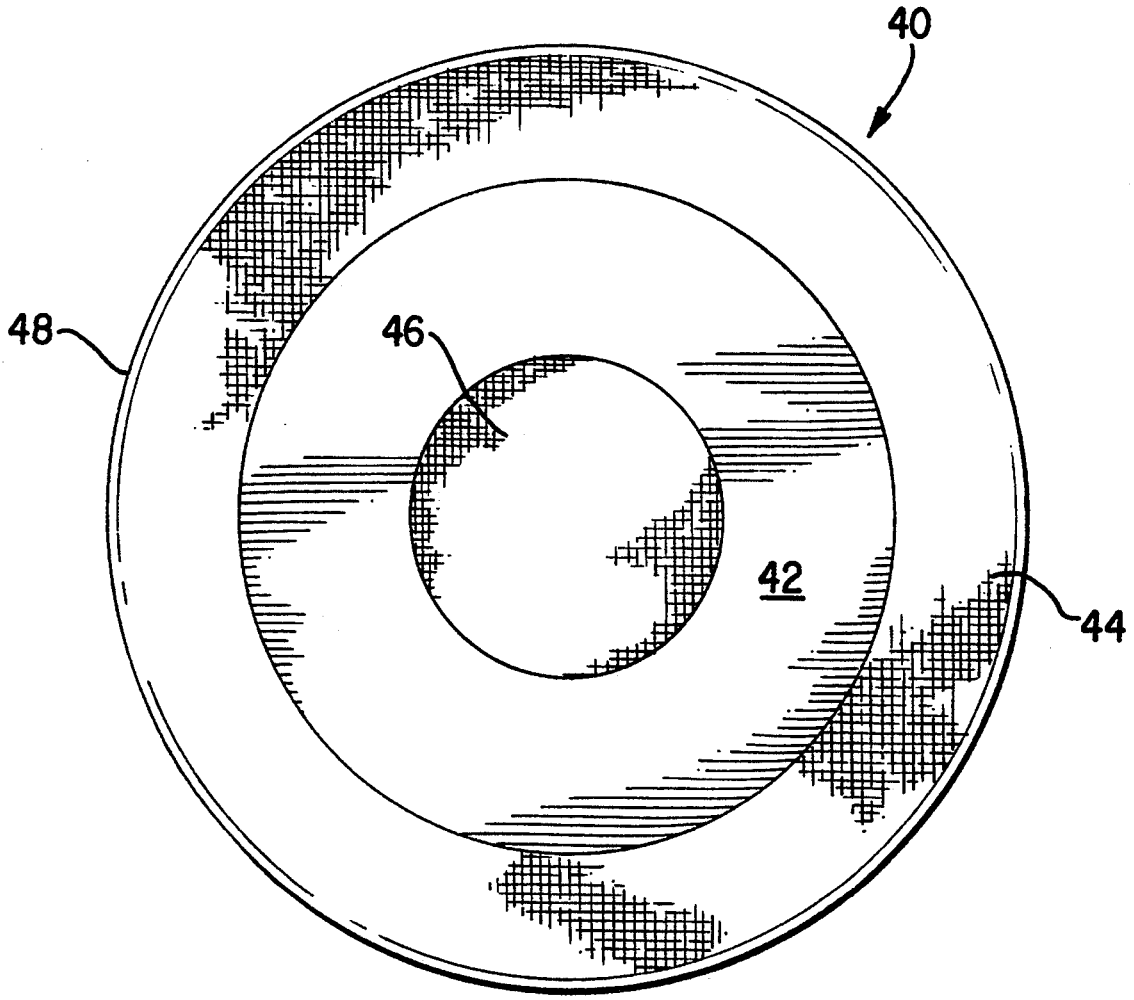
FIG. 2 is a top plan view of a flying disc according to a second embodiment of the present invention.

The second embodiment 40 of the flying disc according to the present invention shown in FIG. 2 illustrates an alternative to the flying disc 20 of FIG. 1. The flying disc 40 comprises one meshed panel 44 provided within the periphery of the circular rim member 48, and an additional non-meshed panel 42 centered and stitched onto one surface of the meshed panel 44. Another non-meshed panel (not shown) is preferably stitched onto the opposite surface of the meshed panel 44 in corresponding position with the non-meshed panel 42 to improve the aesthetic appearance of the flying disc 40.

The flying disc 40 may also be made by providing a non-meshed panel 42 and an outer peripheral mesh portion 44 in addition to a central mesh portion 46. Both mesh portions 44 and 46 each have one annular edge that is stitched or otherwise attached to the two annular edges of the panel 42. The outer peripheral mesh portion 44 also has an outer annular edge that is attached to the inside peripheral edge of the circular rim member 48.

The mesh portions 44 and 46 may be made from any of the materials and by any of the methods described above in connection with mesh portion 30 of flying disc 20. The circular rim member 48 is identical to the rim member 22 for the flying disc 20 of FIG. 1, and is attached, by stitching, mechanically fastening, fusing or gluing to the outer peripheral mesh portion 44. The panel 42 preferably covers about forty percent of the entire surface area of the combined outer peripheral mesh portion 44, panel 42 and the central mesh portion 46.

Figure 3:
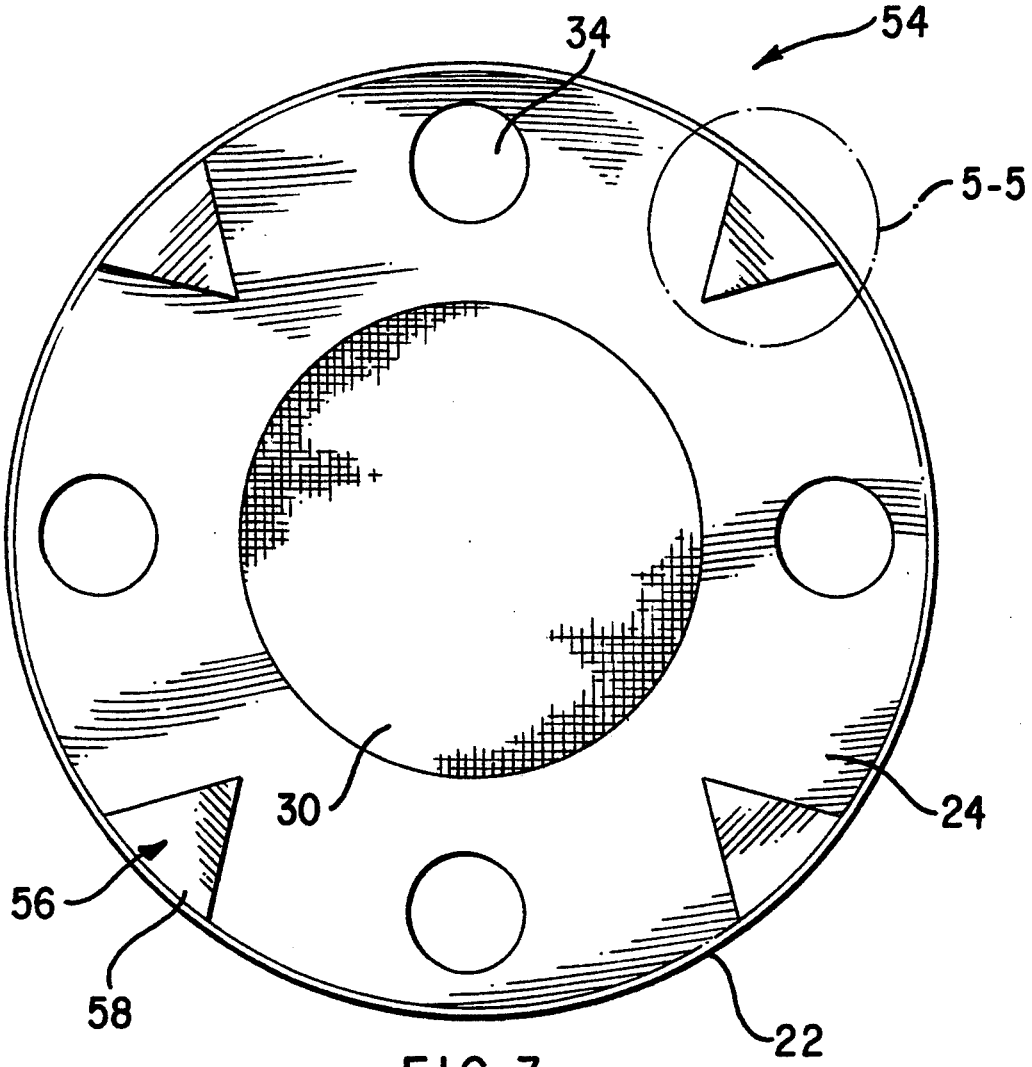
FIG. 3 is a top plan view of a flying disc according to a third embodiment of the present invention.

FIG. 3 illustrates a third embodiment 54 of the flying disc of the present invention which is essentially the same as the flying disc 20 of FIG. 1, except that weights 56 are provided in spaced apart manner along the periphery of the outer rim member 22 (see also FIG. 5). For ease of reference, the same numerals used for identifying the elements of the flying disc 20 of FIG. 1 are retained for the same elements in flying disc 54 of FIG. 3. In a preferred embodiment, the weights 56 are made of a small triangular bag or pouch 58 that is filled with sand or other weighty material, such as metal or plastic. One side of the triangular bag 58 is stitched, sewn or otherwise attached along stitch line 60 to the inner periphery of the outer rim member 22. Alternatively, the weights 56 may take the form of a whistle, a bell or other hanging object. The total number of the weights 56 that may be used can be varied, but the weights 56 must be spaced apart and evenly distributed along the periphery of the rim member 22 to ensure that the flying disc 54 flies properly. It will be understood by those skilled in the art that the weights 56 may be provided in addition to the weight of the resilient loop 28 when desired, or omitted entirely.

Further, the non-meshed panels of any of the embodiments of the present invention may be provided with different colors to increase the aesthetic appeal of the flying discs.

Figure 4A:
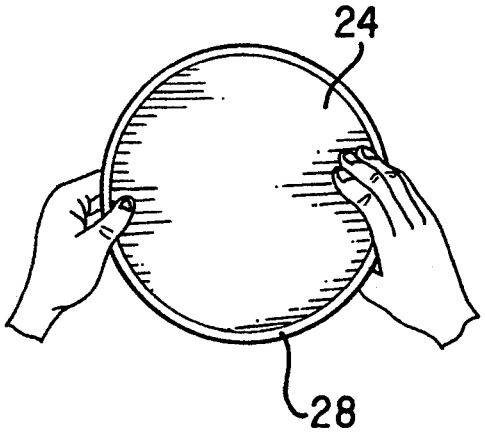
FIGS. 4A–4D illustrate how the flying disc of FIG. 1 is folded and collapsed into a smaller size.
Figure 4B:
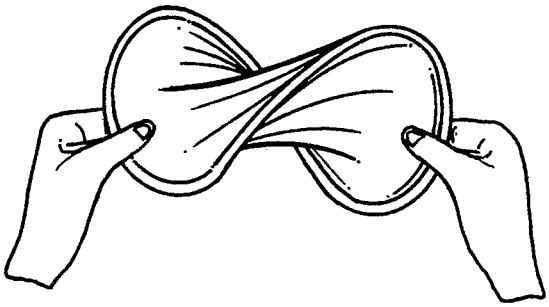
Figure 4C:
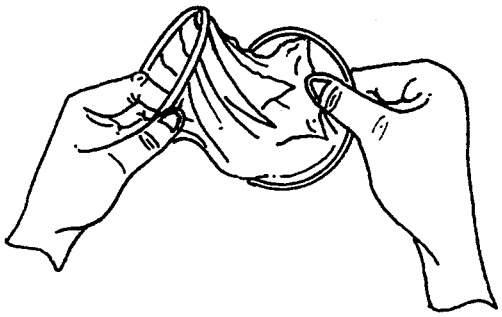
Figure 4D:
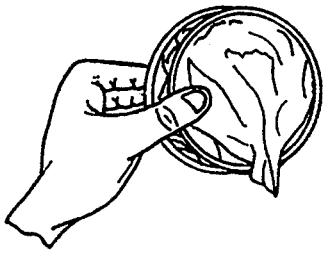

FIGS. 4A through 4D describe the various steps for folding and collapsing the flying disc 20 of FIG. 1. However, it will be appreciated that the folding and collapsing method is equally applicable to all the other described embodiments. In the first step shown in FIG. 4A, each of the opposite borders of the flying disc 20 is held by a separate hand. The opposite borders are then turned in opposite directions to form a "Figure-8" shape (see FIG. 4B). Further twisting and folding (see FIG. 4C) causes the loop 28 and the panel 24 to form a plurality of concentric loops and layers of the panels. FIG. 4D shows the loop 28 and panel 24 collapsed on each other to provide for a small essentially compact configuration having a plurality of concentric loops and layers of the panels so that the collapsed structure has a size which is a fraction of the size of the initial structure.

Figure 6:
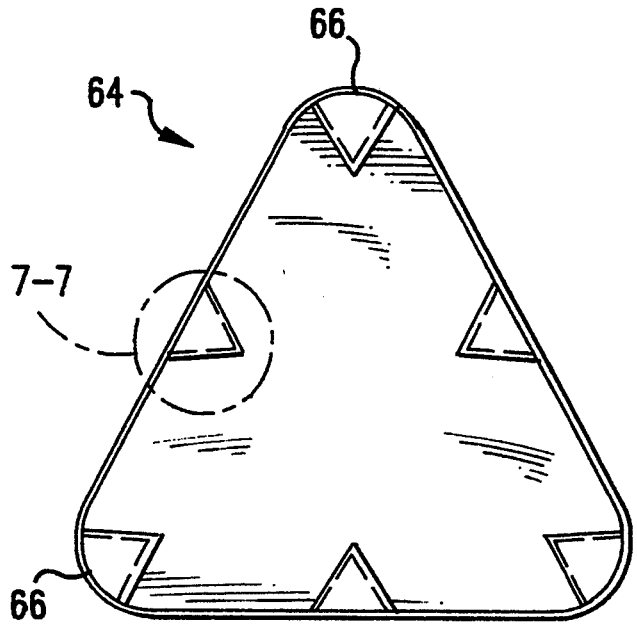
FIG. 6 is a top plan view of a flying disc according to a fourth embodiment of the present invention.
Figure 7:
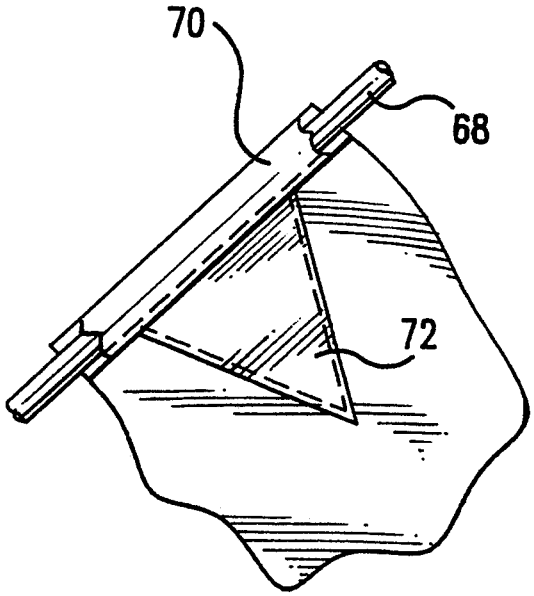
FIG. 7 is a cut-away perspective view of section 7—7 of FIG. 6 showing the straight resilient loop housed in a straight binding of the flying disc of FIG. 6 and a weight provided along the periphery thereof.
Figure 15A:
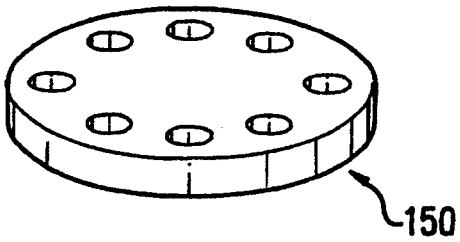
FIG. 15*a* is a perspective view of a flying disc according to an eighth embodiment of the present invention.
Figure 15B:
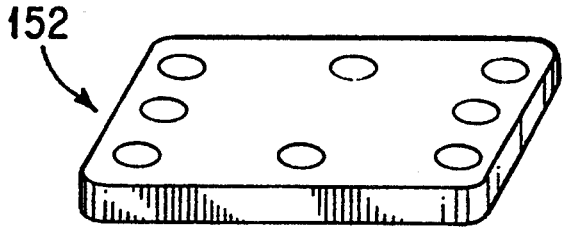
FIG. 15*b* is a perspective view of a flying disc according to a ninth embodiment of the present invention.
Figure 15C:
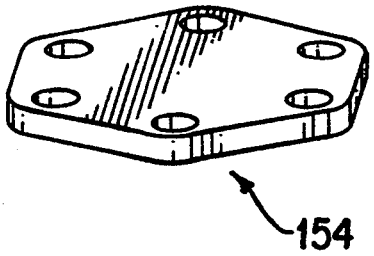
FIG. 15*c* is a perspective view of a flying disc according to a tenth embodiment of the present invention.
Figure 15D:
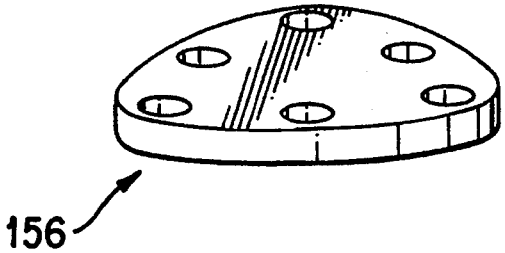
FIG. 15*d* is a perspective view of a flying disc according to an eleventh embodiment of the present invention.

The flying disc of the present invention may take a variety of external shapes. The resilient loop for each of these differing shapes assumes the same configuration of the flying disc. For example, FIG. 6 illustrates a fourth embodiment of the flying disc 64 which is triangular in shape and has curved apexes 66. Therefore, the resilient loop 68 essentially comprises three substantially straight sections connected by three curved sections corresponding to the three apexes 66. Again, the resilient loop 68 can be made from one continuous strip of material or it can be made from a plurality of sections connected together at the apexes. FIG. 7 illustrates the cut-away section 7—7 of FIG. 6 showing a portion of a straight resilient loop 68 housed in a portion of a straight binding 70 of the flying disc 64, and with a weight 72 provided along the periphery of the binding 70.

The flying disc according to the present invention can also be provided with a domed configuration which generates an "air foil" effect for improved lift. FIGS. 8 through 14 illustrate three different embodiments of a domed flying disc according to the present invention.

Figure 8:
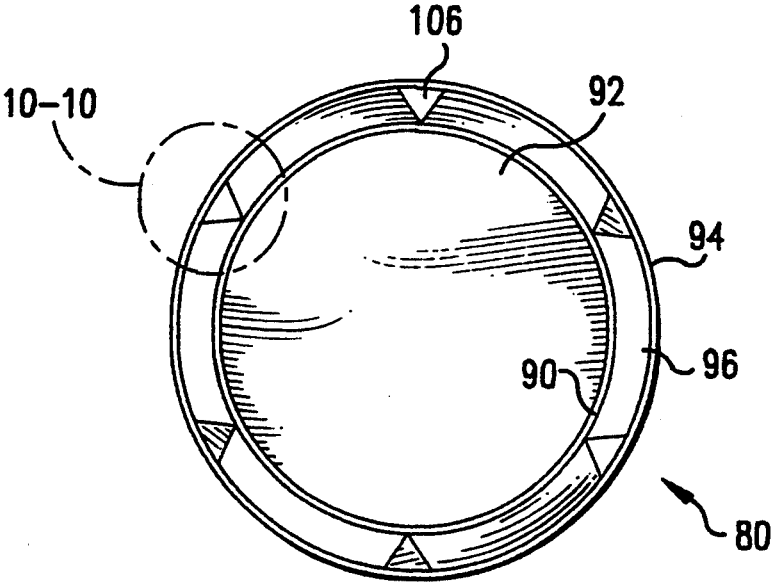
FIG. 8 is a top plan view of a flying disc according to a fifth embodiment of the present invention.
Figure 9:
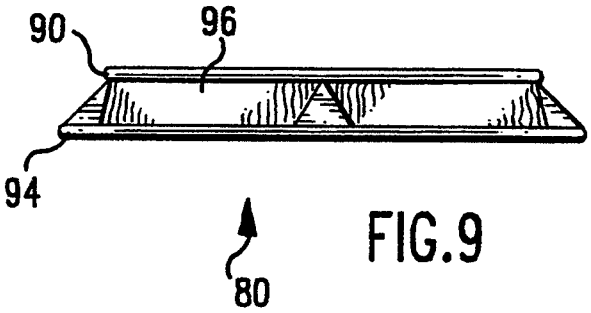
FIG. 9 is a side elevation view of the flying disc of FIG. 8.
Figure 10:
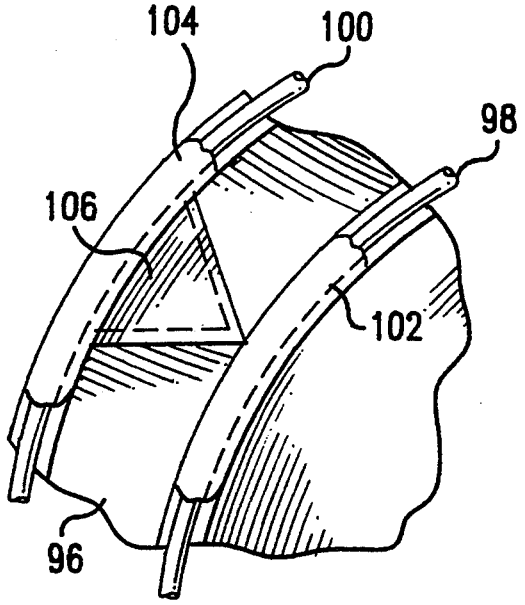
FIG. 10 is a cut-away perspective view of section 10—10 of FIG. 8 showing the curved resilient loops housed in curved bindings of the flying disc of FIG. 8 and a weight provided along a collar thereof.

Referring to FIGS. 8-10, the flying disc 80 according to a fifth embodiment has a circular inside rim member 90 and a panel 92 which may be essentially the same as those described for the flying discs of FIGS. 1, 2 or 3. The flying disc 80 further comprises a circular outside rim member 94 and an annular ring or collar 96 of fabric material provided between the rim members 90 and 94. The annular ring 96 is preferably made from the same material as the panel 92.

FIG. 10 illustrates the cut-away section 10—10 of FIG. 8 showing a curved inside resilient loop 98 and a curved outside resilient loop 100 housed in curved bindings 102 and 104, respectively, of the flying disc 80. The outside peripheral edge of the collar 96 is attached to the outside binding 104 by the same methods described above in connection with FIG. 5. Additionally, the inside peripheral edge of the annular ring 96 is attached to the inside binding 102 by sewing, stitching, mechanically fusing or gluing or by other such conventional means. Weights 106 such as those described above may be provided in spaced apart manner along the annular ring 96. As with the embodiments above, the loops 98 and 100 themselves provide weights to the flying disc 80, so that the weights 106 may be omitted if desired.

Referring to FIGS. 8 and 9, the outside rim member 94 has a larger diameter than the inside rim member 90. Further, both rim members 90 and 94 are disposed on different elevational planes from each other but are substantially parallel to each other so that the collar 96 is actually disposed at an angle. This creates a domed configuration which provides an "air foil" effect facilitating improved lift characteristics.

Furthermore, as with the embodiments above, the rim members 90 and 94 present toroidal leading edges which provide a gyroscopic effect that lends further stability to the flight of the flying disc 80.

To fold and collapse the flying disc 80, the annular ring 96 is first compressed so that both rim members 90 and 94 are disposed on substantially the same elevational plane. The two resilient loops 98 and 100, the panel 92 and the collar 96 are then collectively folded and collapsed according to the method described above in connection with FIGS. 4A—4D. The use of a flexible fabric material for the collar 96 therefore makes it convenient for the user to simultaneously fold and collapse both resilient loops 98 and 100. It will be appreciated that the flying discs 84 and 86 described hereinbelow may be folded and collapsed in a similar manner.

Figure 11:
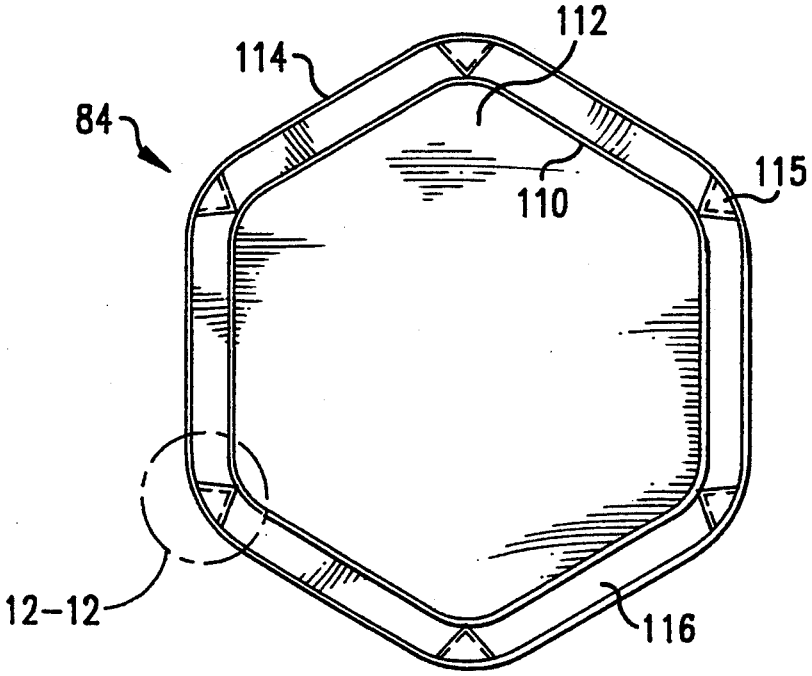
FIG. 11 is a top plan view of a flying disc according to a sixth embodiment of the present invention.
Figure 12:
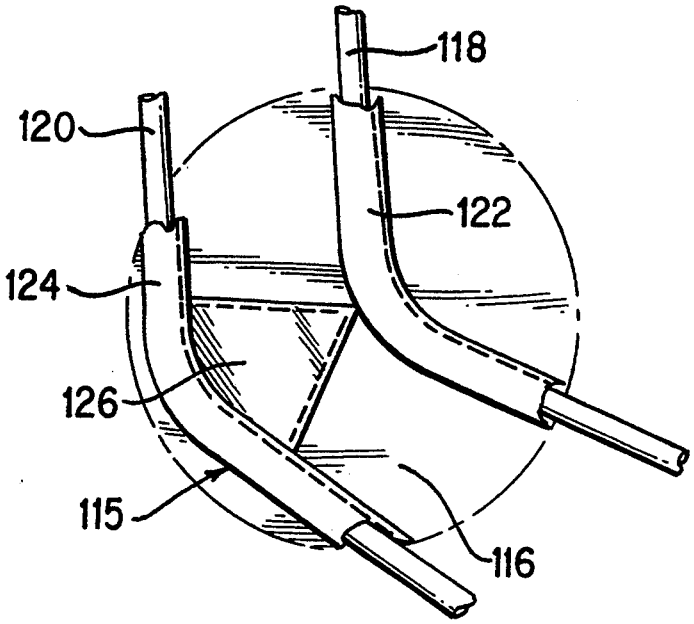
FIG. 12 is a cut-away perspective view of section 12—12 of FIG. 11 showing the resilient loops housed in the bindings of the flying disc of FIG. 11 and a weight provided along a collar thereof.

Referring to FIGS. 11 and 12, the flying disc 84 according to a sixth embodiment has an inside rim member 110 and a panel 112. The flying disc 84 further comprises an outside rim member 114 and a collar 116 of fabric material provided between the rim members 110 and 114. The rim members 110 and 114, the panel 112 and the collar 116 are shaped as a six-sided polygon with curved corners, such as at 115. The collar 116 is preferably made from the same material as the panel 112.

FIG. 12 illustrates the cut-away section 12—12 of FIG. 12 showing a curved portion of an inside resilient loop 118 and an outside resilient loop 120 housed in a curved corner 115 of bindings 122 and 124, respectively, of the flying disc 84. The outside peripheral edge of the collar 116 is attached to the outside binding 124, and the inside peripheral edge of the collar 116 is attached to the inside binding 122 by the same methods described above in connection with the embodiment of FIGS. 8–10. As with that embodiment, optional weights 126 may be provided in spaced apart manner along the collar 116 along the straight portions and even at the curved corners. These weights 126 are optional since the loops 118 and 120 themselves already provide weights to the flying disc 84. As with the previous embodiment, the six sides of the outside rim member 114 are longer or wider than the six sides of the inside rim member 110, and the collar 116 is disposed at an angle, to create a domed configuration.

Figure 13:
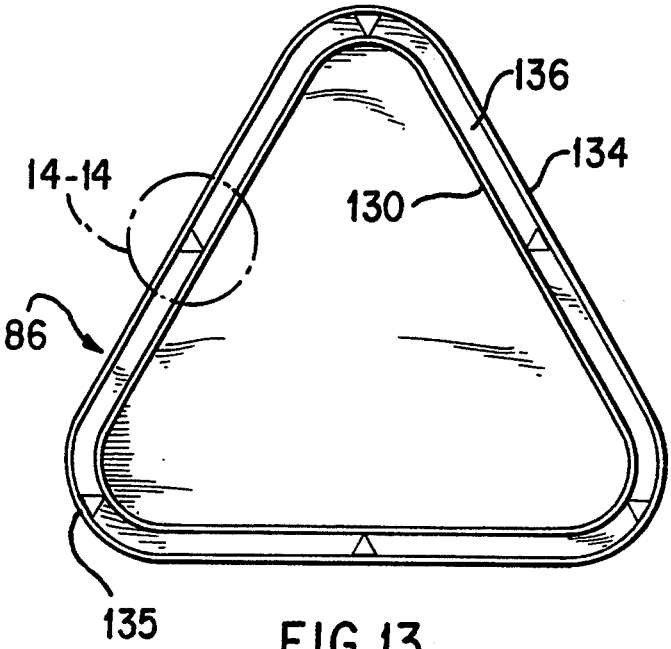
FIG. 13 is a top plan view of a flying disc according to a seventh embodiment of the present invention.
Figure 14:
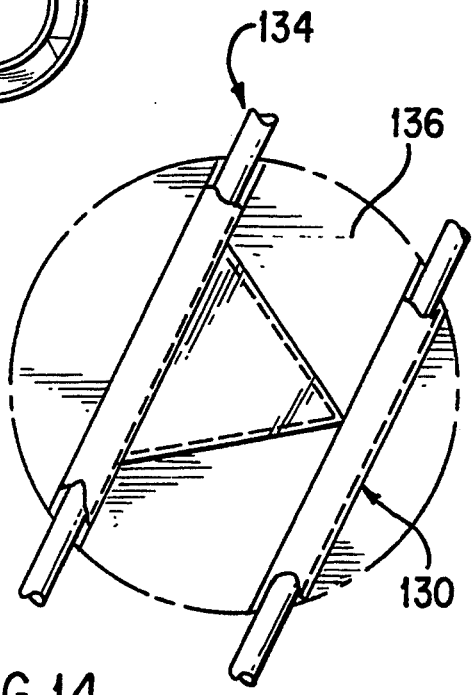
FIG. 14 is a cut-away perspective view of section 14—14 of FIG. 13 showing the resilient loops housed in the bindings of the flying disc of FIG. 13 and a weight provided along a collar thereof.

Referring to FIGS. 13 and 14, the structure and construction of the flying disc 86 according to a seventh embodiment are essentially the same as that of the flying discs 80 and 84 described hereinabove, except that the flying disc 86 has a triangular configuration with three curved apexes 135. Like flying discs 80 and 84, flying disc 86 also has a domed configuration by virtue of the three sides of its outside rim member 134 being longer or wider than the three sides of the inside rim member 130 and the collar 136 disposed at an angle.

FIGS. 15*a*–15*d* illustrate four alternative embodiments 150, 152, 154 and 156 of the flying disc according to the present invention. Like flying discs 80, 84 and 86, each of these flying discs 150, 152, 154 and 156 also have two rim members, an upper rim member and a lower rim member, and a collar provided between the rim members to form a domed configuration. However, the flying discs 150, 152, 154 and 156 differ in that the diameters of the upper and the lower rim members are substantially the same, and the collars are angled substantially vertically. The four different embodiments are shown having different configurations: the flying disc 150 of FIG. 15*a* has a circular configuration; the flying disc 152 of FIG. 15*b* has a substantially square configuration with curved corners; the flying disc 154 of FIG. 15*c* has a polygonal configuration with curved corners; and the flying disc 156 of FIG. 15*d* has a triangular configuration with curved apexes. The flying discs 150, 152, 154 and 156 may be folded and collapsed in the same manner as that described above for flying disc 80, except that in the first step, the upper rim member is compressed to rest against the lower rim member in substantially the same plane before the twisting and folding steps are implemented.

The flying discs 80, 84, 86, 150, 152, 154 and 156 have not been described in FIGS. 8–15 as having openings and mesh portions in their respective panels, but mesh portions and openings similar to those described above in connection with the embodiments of FIGS. 1–3 can be provided without departing from the spirit and scope of the present invention.

The flying discs 20, 40, 54, 64, 80, 84, 86, 150, 152, 154 and 156 may assume any shape and size other than those shown and described above. However, the disc must be of a size that allows the user to conveniently hold, grasp, and toss the flying disc.

Thus, the flying discs according to the present invention provides a flexible flying disc that is lightweight, is easy to use, and is inexpensive to manufacture. The flying discs according to the present invention can be easily folded and collapsed to fit conveniently in a pocket. These flying discs are also aerodynamically sound, and are stable in flight. In particular, each rim member of the flying discs of the present invention presents a toroidal leading edge which provides a gyroscopic effect that lends further stability to the flight of the flying disc. Further, the embodiments of FIGS. 8-15 have two loops and two rim members separated by a collar to provide a domed configuration which facilitates improved lift characteristics.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A flexible flying disc, comprising:

an enclosed resilient loop having a folded and an unfolded orientation;

a peripheral binding for retaining the resilient loop, the binding having an internal periphery and an internal edge along the internal periphery thereof;

a meshed panel substantially covering the resilient loop in its unfolded orientation and attached to the internal edge of the binding, the meshed panel having means for allowing air to pass therethrough; and at least one non-meshed panel stitched to a portion of the meshed panel to cover the portion of the meshed panel;

wherein the resilient loop and panels may be twisted and folded to form a plurality of concentric loops and panels to substantially reduce the size of the flying disc.

2. The flying disc of claim 1, wherein the means for allowing air to pass through the meshed panel comprises a mesh portion provided in a central portion of the panel.

3. The flying disc of claim 2, wherein the means for allowing air to pass through the meshed panel further comprises a plurality of openings provided in spaced apart manner along the meshed panel.

4. The flying disc of claim 1, wherein the means for allowing air to pass through the meshed panel comprises a plurality of openings provided in spaced apart manner along the meshed panel.

5. The flying disc of claim 2, wherein the means for allowing air to pass through the meshed panel further comprises a peripheral mesh portion provided adjacent the internal edge of the binding.

6. The flying disc of claim 1, further comprising a plurality of weights provided in spaced apart manner adjacent the internal edge of the binding.

7. The flying disc of claim 1, wherein the resilient loop is made of a coilable flexible material.

8. A flying disc, comprising:

a first enclosed rim member having a folded and an unfolded orientation, the first enclosed rim member having an inner edge and an outer edge;

a meshed panel substantially covering the first enclosed rim member in its unfolded orientation and attached to the inner edge of the first enclosed rim member;

at least one non-meshed panel stitched to a portion of the meshed panel to cover the portion of the meshed panel;

a second enclosed rim member having a folded and an unfolded orientation, the second enclosed rim member having an inner edge; and a collar surrounding the first enclosed rim member and having a first edge attached to the outer edge of the first enclosed rim member, and a second edge attached to the inner edge of the second enclosed rim member in its unfolded orientation;

wherein the first and second enclosed rim members, the panels and the collar may be twisted and folded to form a plurality of concentric rim members and panels to substantially reduce the size of the flying disc.

9. The flying disc of claim 8, wherein the first and second enclosed rim members are disposed parallel to each other but at different elevational planes such that the collar connecting the first and second rim members is disposed at an angle to form a domed structure.

10. The flying disc of claim 9, wherein each of the first and second enclosed rim members comprises a resilient loop retained inside a binding.

11. The flying disc of claim 8, wherein the meshed panel further comprises a mesh portion provided in a central portion of the meshed panel.

12. The flying disc of claim 11, wherein the meshed panel further comprises a plurality of openings provided in spaced apart manner along the meshed panel.

13. The flying disc of claim 8, wherein the panel comprises a plurality of openings provided in spaced apart manner along the meshed panel.

14. The flying disc of claim 8, further comprising a plurality of weights provided in spaced apart manner along the collar between the first and second enclosed rim members.

15. A method of folding and collapsing a flying disc, comprising the steps of:

(a) providing a flying disc comprising:

(i) a first enclosed rim member having a folded and an unfolded orientation, the first enclosed rim member having an inner edge and an outer edge;

(ii) a panel substantially covering the first enclosed rim member in its unfolded orientation and attached to the inner edge of the first enclosed rim member;

(iii) a second enclosed rim member having a folded and an unfolded orientation, the second enclosed rim member having an inner edge; and (iv) a collar surrounding the first enclosed rim member and having a first edge attached to the outer edge of the first enclosed rim member, and a second edge connected to the inner edge of the second enclosed rim member in its unfolded orientation;

(v) wherein the first and second enclosed rim members are disposed parallel to each other but at different elevational planes such that the collar is disposed at an angle;

(b) compressing the collar such that the first and second enclosed rim members are disposed along the substantially the same plane; and (c) twisting and folding the first and second enclosed rim members, the panel and the collar to form a plurality of concentric rim members and panels to substantially reduce the size of the flying disc.

* * * * *